United States Patent [19]

Hauan

[11] 4,269,538

[45] May 26, 1981

[54] BARRIER ATTACHED TO THE SIDE OF A SHIP

[75] Inventor: Nils F. Hauan, Lillestrom, Norway

[73] Assignee: Skuteng A/S, Oslo, Norway

[21] Appl. No.: 947,815

[22] Filed: Oct. 2, 1978

[30] Foreign Application Priority Data

Oct. 10, 1977 [NO] Norway ..... 773453

[51] Int. Cl.[3] ..... E02B 15/04

[52] U.S. Cl. ..... 405/63; 114/270; 405/65; 405/70; 210/242.3; 210/923; 210/924

[58] Field of Search ..... 114/120, 123, 230, 232, 114/233, 234, 267, 270; 210/242 R, 242 S, 242 AS, DIG. 25, DIG. 26; 405/60, 63, 64, 65, 66, 68, 69, 70, 71, 72; 43/7, 8, 14

[56] References Cited

U.S. PATENT DOCUMENTS

| | | | |
|---|---|---|---|
| 2,240,567 | 5/1941 | Meacham et al. | 405/65 |
| 3,612,280 | 10/1971 | Fitzgerald | 210/242 S |
| 3,685,297 | 8/1972 | Juodis | 405/72 X |
| 3,750,723 | 8/1973 | Schirtzinger | 114/230 X |
| 3,990,975 | 11/1976 | McLellan | 210/242 AS |
| 4,015,431 | 4/1977 | Ahiko | 144/270 X |
| 4,016,726 | 4/1977 | Campbell et al. | 405/71 |

*Primary Examiner*—George E. A. Halvosa
*Attorney, Agent, or Firm*—Burns, Doane, Swecker & Mathis

[57] ABSTRACT

A barrier is attached to the side of a ship and extends outwardly therefrom. The barrier, in a transition region at the side of the ship, increases in height toward the side of the ship, thus forming a barrier sail which preferably extends from the height of the deck and down to the beginning of the bilge section at the side of the ship, the floating section of the barrier extending along the upper edge region of the barrier sail and gradually decreasing in diameter toward the side of the ship, and the barrier sail being inserted into a vertical slot affixed to the side of the ship.

6 Claims, 3 Drawing Figures

WATER SURFACE 11
13
12
10
9
2
26
27
14
10
15
19
17
16
18
20
21
22
23
25
1

10
9
2
10
3
24
1

BARRIER ATTACHED TO THE SIDE OF A SHIP

The invention pertains to a barrier which is attached to and extends outwardly from the side of a ship, the barrier comprising a floating section and a skirt section depending therefrom.

Specifically, the aim of the invention is to provide a barrier which extends forward at an angle from a point on the side of the ship, usually at an angle of about 20° relative to the side, which is adapted to collect and contain oil pollution and the like so that it may be led into tanks inside the ship through suitable openings provided in the side of the ship.

In barrier embodiments of this type, the transition region between the barrier and the side of the ship is a vulnerable area. The barrier must be connected to the side of the ship with a certain degree of free play in several directions, i.e., the coupling provided between the barrier and the side of the ship must be of the universal joint type, or at least approximately so. The ship also moves in the sea, and the ship's rolling movements in particular must be taken into account in determining the configuration of the barrier-to-ship transition, so that the ship's rolling does not cause the barrier to become ineffectual in this important region. To solve this problem, therefore, it is proposed according to the invention that the height of the barrier be increased near the side of the ship, such that an extension of the barrier, a barrier sail, is formed extending from a first predetermined location on the side of the ship above the surface of the water to a second predetermined location on the side of the ship beneath the surface of the water, preferably extending from deck height and down to the beginning of the bilge section at the side of the ship. The floating section of the barrier continues along the upper edge region of the barrier sail, but its diameter gradually decreases toward the side of the ship. The barrier sail is inserted into a vertical slot affixed to the side of the ship. The increased height of the barrier near the side of the ship is preferably obtained in that the upper and lower edges of the barrier sail diverge and deviate from the horizontal, i.e., the still water surface.

Preferably, the floating section of the barrier has an approximately circular cross section and contains a succession of inflatable float bodies disposed along the length of the barrier.

A ballast chain is preferably provided along the bottom edge of the skirt, at the skirt-to-barrier sail transition, the ballast chain is connected to another chain that extends along the lower edge of the barrier sail to the side of the ship, the coupling being made such that at least approximately full freedom of movement is obtained in the transition area, i.e., essentially a universal joint. At the lower edge of the floating section of the barrier, a longitudinal rope is preferably provided, being connected at the transition to the barrier sail to a plurality of other ropes which diverge in the barrier sail and run forward to the edge of the barrier sail that is adjacent to the side of the ship. The transition between the ropes and between the chains is a rigid connection.

Said rigid connection is preferably built into a fixed float body in the floating section.

To facilitate its insertion into the slot, the edge of the barrier sail adjacent to the side of the ship is preferably provided with a plurality of reciprocally flexible, interconnected T-bars whose cross beams are inserted into the vertical slot on the side of the ship.

The structure outlined above provides a suitable and flexible connection and transition between the side of the ship and the barrier.

The invention will be further elucidated with reference to the accompanying drawings, which illustrate a preferred embodiment of the invention.

Figure 1:
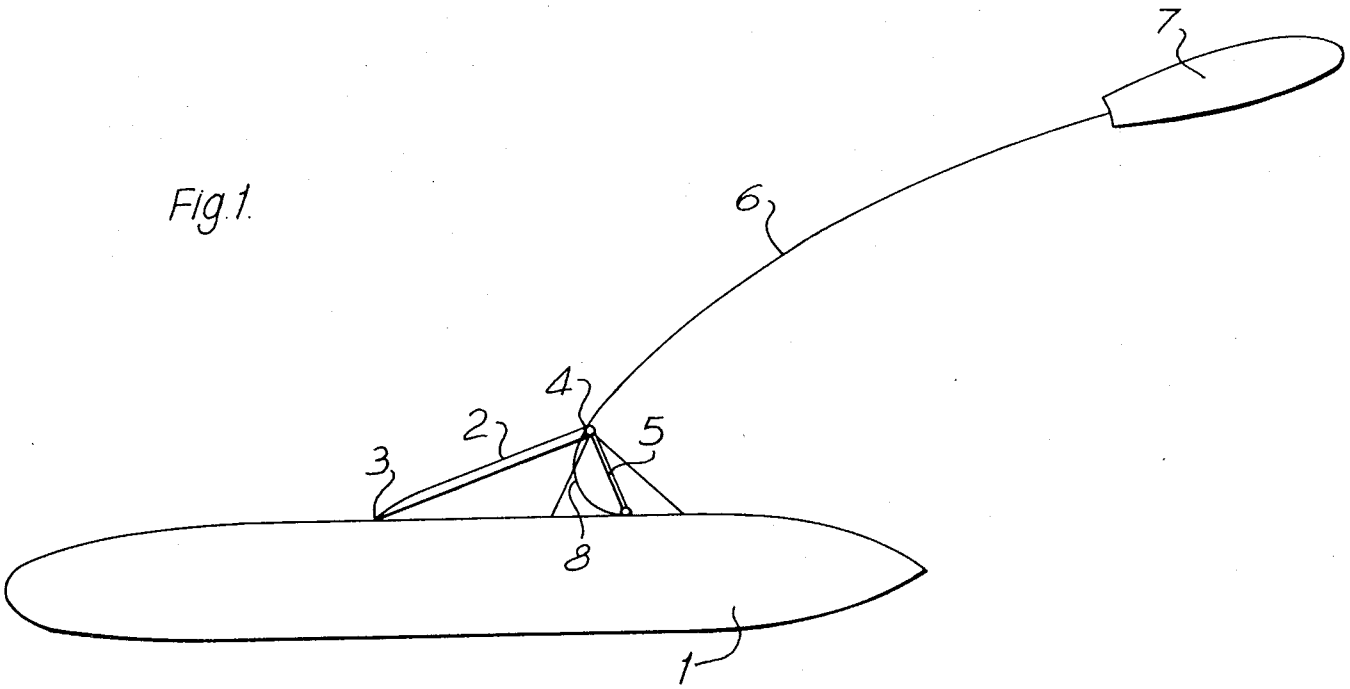
FIG. 1 depicts a ship with deployed barriers, in plan view.

The drawings are schematic and are merely intended to illustrate the principle of the idea on which the invention is based. FIG. 1 shows a tanker 1 or a vessel which is adapted to take on oil which is floating on the surface of the water through an opening, not shown, in side of the ship, in the region lying within a barrier 2 which extends out from a point 3 on the side of the ship and forward, forming an angle of about 20° with the side of the ship. The outer end 4 of the barrier 2 is held out from the side of the ship by means of a rigid boom 5 which has universal coupling supports at both ends, i.e., at the side of the ship and at the barrier 2, respectively. An additional barrier 6 is attached to a tugboat 7. From the point 4 a line 8 also runs in to the side of the ship, optionally having the configuration of a type of barrier, but having large openings such that the oil floating on the water surface can be collected in the bilge space between the side of the ship and the barrier 2.

Figure 2:
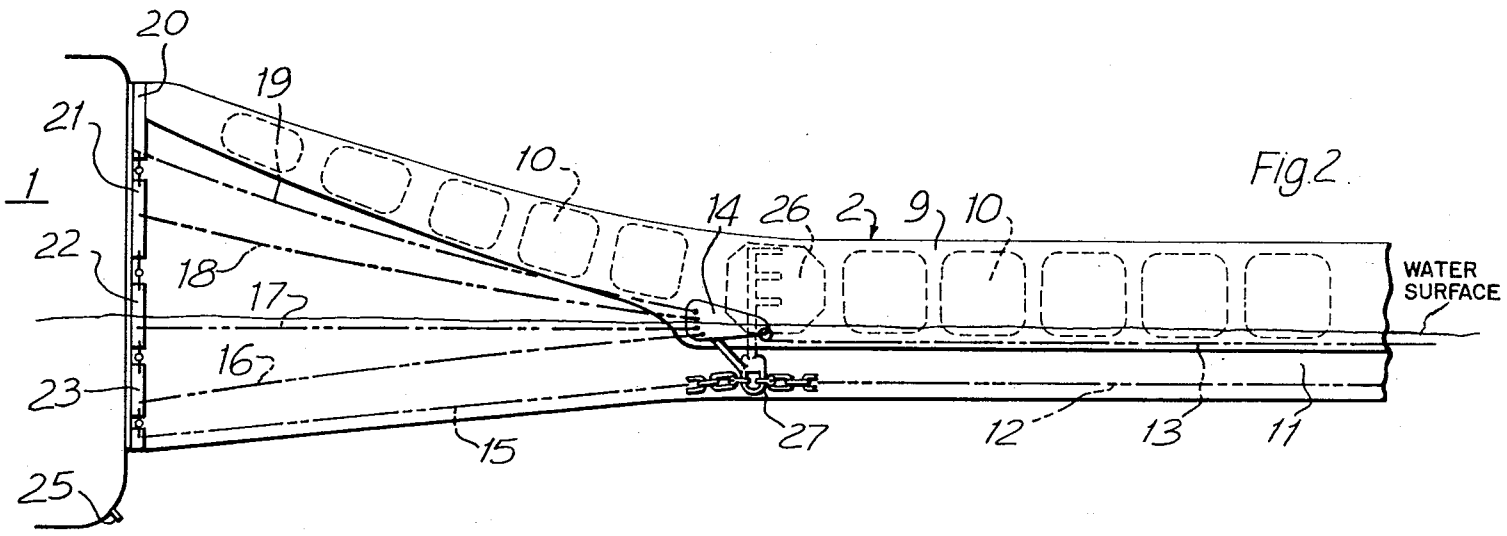
FIG. 2 is a schematic drawing of a barrier in the transition region to the side of a ship, in vertical projection.
Figure 3:
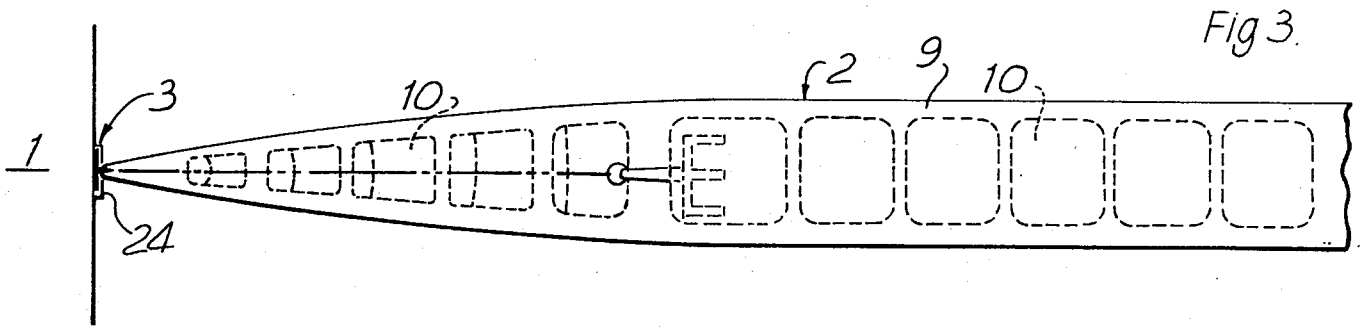
FIG. 3 shows the embodiment of FIG. 2 in plan view.

The barrier 2 has the configuration shown on FIGS. 2 and 3. In essence, the barrier is constructed of a floating section 9 which has an approximately circular cross section and contains a plurality of separate, inflatable float bodies 10. Depending from the bottom of the floating section 9 is a skirt 11 which is weighted at the bottom by a chain 12. To absorb tensile stresses in the barrier 2, a longitudinal rope 13 is disposed in the area between the floating section 9 and the skirt 11.

As seen on FIG. 2, the height of the barrier increases toward the side of the ship 1, and the floating section extends all the way in to the side of the ship, but with decreasing diameter; similarly, the inflatable float bodies 10 gradually decrease in diameter in this region. This section of the barrier is designated the barrier sail.

The ballast chain 12 has an articulated connection to a rigid structure 14, and a similar chain 15 continues further from the point of connection 27 to the side of the ship. In this region, therefore, an approximately free connection is formed between the two chains 12 and 15. The rope 13 is also connected to the rigid structure 14, which can be made of steel, for example, and in the example illustrated here, four ropes 16, 17, 18 and 19 extend out from the rigid structure 14, diverging in direction toward the side of the ship and being connected to respective T-bars at the edge of the barrier sail adjacent to the side of the ship. The T-bars are designated 20, 21, 22 and 23, and the cross beams thereof fit into a slot 24 (FIG. 3) which is welded onto the side of the ship 1. The chain 15 is also connected to a T-bar 25 which also is inserted into the slot 24.

The rigid structure 14 is in this case built into a fixed float body 26. This float is disposed in the floating section of the barrier, in the transition region between the conventional barrier and the barrier sail, as can be seen on FIGS. 2 and 3.

In practical embodiment, the floating section could have a diameter of about 3 meters, for example. The distance from the side of the ship to the transition region 14 could be about 15 meters, while the total length for the barrier 2 (FIG. 1) could be about 65 meters and the length of the barrier 6, 200 meters. The skirt could extend to a depth of about 2.5 meters. The total height of the barrier sail at the side of the ship would in this case preferably be about 9 meters.

The longitudinal rope 13 and its tensioncounteracting ropes 16, 17, 18 and 19 are preferably "aramide" ropes. Such ropes can have a breaking strength of 160.000 kp, for example. The ballast of chain at the lower edge of the skirt preferably has a weight of 100 kg/m and a breaking strength of over 160.000 kp. The chain will thus function both as ballast weight and as a longitudinal strengthening member.

Having described my invention, I claim:

1. A barrier attached to a side of a ship and extending outwardly therefrom, comprising a floatable section and a skirt section depending therefrom, the floatable section being in contact with a surface of the water along a first portion of the barrier, said first portion extending from a free end of the barrier to a first location on the barrier, a second portion of the barrier, near the side of the ship, increasing in height from the first location on the barrier toward the side of the ship, thus forming a barrier sail which extends continuously from a first predetermined location on the side of the ship above the surface of the water down to a second predetermined location on the side of the ship beneath the surface of the water, the floatable section of the barrier extending along an upper edge region of the barrier sail and gradually decreasing in diameter toward the side of the ship, and said barrier sail being inserted into a vertical slot affixed to the side of the ship.

2. A barrier according to claim 1, wherein the floatable section has an approximately circular cross section and contains inflatable bodies arranged in succession along a longitudinal direction of the barrier.

3. A barrier according to claim 1, wherein a ballast chain along a bottom edge of the skirt section is connected, at approximately the first location on the barrier, to a chain which extends along a lower edge of the barrier sail, the connection being such that a universal joint is obtained at approximately said first location, and a longitudinal rope at a bottom edge of the floatable section of the barrier, at approximately the first location on the barrier, is connected to a plurality of ropes which diverge in the barrier sail and extend to the edge of the barrier sail adjacent to the side of the ship, the ropes and the chains being connected by a rigid structure.

4. A barrier according to claim 3, characterized in that said rigid structure is built into a fixed float body disposed in the floatable section.

5. A barrier according to claim 1, characterized in that the edge of the barrier sail adjacent to the side of the ship comprises a plurality of reciprocally flexible, interconnected T-bars whose cross beams are inserted into the vertical slot on the side of the ship.

6. A barrier attached to a side of a ship comprising:

a floatable section;

a skirt depending from the floatable section;

the floatable section of the barrier contacting a surface of the water along a first portion of the barrier, said first portion extending from a free end of the barrier to a first location on the barrier;

a second portion of the barrier near the side of the ship increasing in height from the first location on the barrier towards the side of the ship and extending continuously from a first predetermined location on the side of the ship above the surface of the water to a second predetermined location on the side of the ship beneath the surface of the water;

the floatable section of the barrier extending along an upper edge region of the second portion of the barrier which increases in height; and said floatable section gradually decreasing in diameter along said upper edge region towards the side of the ship.

* * * * *